United States Patent [19]

Harris

[11] 4,103,715

[45] Aug. 1, 1978

[54] VERSATILE HAND LOOM

[76] Inventor: Ramsay L. Harris, 1175 W. Baseline Rd., Claremont, Calif. 91711

[21] Appl. No.: 853,396

[22] Filed: Nov. 21, 1977

Related U.S. Application Data

[63] Continuation-in-part of Ser. No. 661,692, Feb. 26, 1976.

[51] Int. Cl.[2] ..... D03D 29/00

[52] U.S. Cl. ..... 139/33

[58] Field of Search ..... 139/29, 30, 31, 32, 139/33, 34

[56] References Cited

U.S. PATENT DOCUMENTS

| | | | |
|---|---|---|---|
| 2,114,206 | 4/1938 | Bayan | 139/29 |
| 2,274,326 | 2/1942 | Gallinger | 139/33 |
| 2,305,328 | 12/1942 | Turner | 139/68 |
| 2,305,333 | 12/1942 | Wakefield | 139/68 |
| 2,558,284 | 6/1951 | Whitaker | 139/55 |
| 2,811,175 | 10/1957 | Nadeau | 139/29 |
| 3,332,448 | 7/1967 | Simons | 139/29 |
| 3,998,246 | 12/1976 | Strousser | 139/29 |

FOREIGN PATENT DOCUMENTS

| | | | |
|---|---|---|---|
| 772,361 | 4/1957 | United Kingdom | 139/29 |

*Primary Examiner*—Henry S. Jaudon
*Attorney, Agent, or Firm*—Edward O. Ansell

[57] ABSTRACT

A versatile hand operated loom having features making it uniquely suited for utilization in occupational therapy for hospitalized or institutionalized persons. Simplified hand loom assembly dispensing with the conventional shedding harness enables utilization of simplified procedures in dressing and operating the loom, including weaving of the fabric, removal, and setting up the subsequent weaving operation for the same or a different pattern. The hand loom combines a means for uniformly advancing a plurality of warp threads, shuttle means for moving a weft thread in reciprocal motion across the path of the advancing warp threads in a transverse direction, and means for selectively arranging each of said warp threads in an upper or lower position to form a shed through which the shuttle means passes, which combine a movable warp thread holding means cooperating with a preprogrammed pattern member moving in association with the advancement of the warp threads to determine the relative position of each warp thread in conformance with the program contained on said pattern member, whereby a woven fabric of predetermined weave and pattern is obtained.

7 Claims, 7 Drawing Figures

VERSATILE HAND LOOM

CROSS-REFERENCE TO OTHER APPLICATION

This application is a continuation-in-part of my copending application Ser. No. 661,692 filed Feb. 26, 1976, the disclosure of which is incorporated by reference herein.

BACKGROUND OF THE INVENTION

1. Field of the Invention

This invention relates to looms for weaving cloth in general, and to portable hand looms in particular which require no expertise to operate because of the intrinsic use of preprogrammed pattern sheets upon which data representing the desired weave and pattern have been previously entered.

2. Description of the Prior Art

Looms of prior art utilizing conventional shedding harnesses necessitate a tedious process of "dressing" or preparing the loom for use. Further, in many instances, it is difficult, if not impossible to remove a partially completed project from the loom to be set aside and subsequently replaced upon the loom and completed. Additionally, because of the utilization of a harness, the construction of such looms is such that they occupy a great deal of space. Although harness-less looms are not new in the art, many of them are difficult to operate, requiring a certain degree of expertise upon the part of the operator.

While hand looms without harnesses are not unknown, see for example U.S. Pat. No. 3,332,448 to Simons issued July 25, 1967, entitled "Portable Hand Loom for Weaving," the combination of such a construction with a preprogrammed pattern member moving in association with advancing warp threads (as shown in patents to Turner, U.S. Pat. No. 2,305,328, issued Dec. 15, 1942, and entitled "Paper Pattern Indicated Loom Dobby," and the patent to Whitaker, U.S. Pat. No. 2,558,284, issued June 26, 1951 and entitled "Heddle Control for Looms"), combined with the other novel features of the present loom construction and method of operation are unknown and unobvious.

SUMMARY OF THE INVENTION

In its broadest aspect, the present invention relates to a versatile hand loom having features making it uniquely suited for utilization in occupational therapy for hospitalized or institutionalized persons. In its preferred embodiment it comprises a simplified hand loom assembly which dispenses with the conventional shedding harness, thereby enabling utilization of simplified procedures in dressing and operating the loom, including weaving of the fabric, removal, and the setting-up of subsequent weaving operations for the same or a different pattern. The hand loom itself combines a means for uniformly advancing a plurality of warp threads, shuttle means for moving a weft thread in reciprocal motion across the path of the advancing warp threads in a transverse direction, and means for selectively arranging each of said warp threads in an upper or lower position to form a shed through which the shuttle means passes. The latter means comprises a movable warp thread holding means which cooperates with a preprogrammed pattern member moving in association with the advancement of the warp threads to determine the relative position of each warp thread in conformance with the program contained on the pattern member, whereby a woven fabric of predetermined weave and pattern is obtained. The latter means is constructed in a manner permitting ready loading and unloading of the pattern member irrespective of whether the loom is dressed, permitting the consecutive utilization of a plurality of different patterns in the weaving of a single fabric.

DESCRIPTION OF THE PREFERRED EMBODIMENTS

Figure 1A:
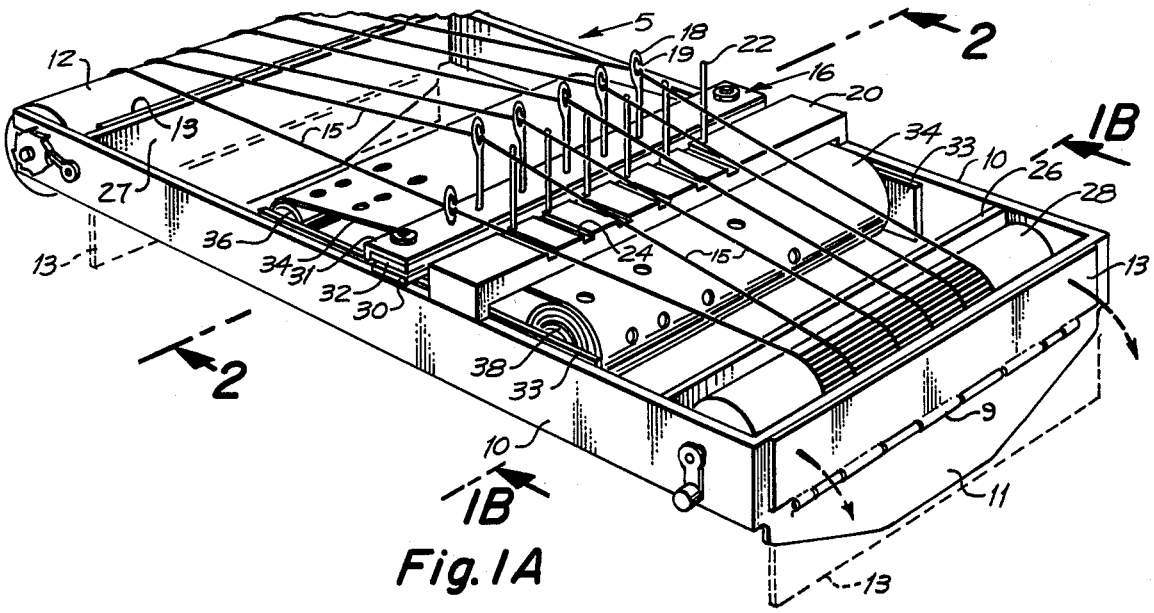
FIG. 1A is an overall perspective view of the loom assembly, with the shuttle mechanism removed.

As may be seen from FIGS. 1 through 4, in its broadest aspect, the loom assembly 5 utilizes a warp beam 12 and cloth beam 28 arranged between parallel sideboards 10 and associated components to be hereinafter described. Also transversely associated with the parallel sideboards 10 are rocker members 11 adjacent to both the ends housing the warp beam 12 and cloth beam 28, rocker support members 13 being attached by a hinge 9 to one or more of the rocker members 11, to be extended downwardly to give rigid horizontal support when the loom assembly 5 is not being rocked. (See FIG. 1A). When the loom is dressed, as hereinafter described, the warp threads 15 progress from the warp beam 12 through a plurality of warp holding members 18, hereinafter "heddles," arranged on a warp bar assembly 16 which selectively raises or lowers them in accordance with a predetermined program, as will also be hereinafter described. A heddle 18 is provided for each warp thread 15, each member having a slotted head portion 19 adapted to receive the warp thread 15. A grooved shuttleboard 20 bearing a plurality of upright reeds is arranged transversely of the sideboards 10 between the warp bar assembly 16 and the cloth beam 28. The function of the shuttleboard 20 is two-fold; beside providing a transit path for the shuttles 45, the grooves 24 therein accommodate the warp threads 15 below the upper surface of the board 20 along which the shuttles 45 providing the weft, or crossthreads, move in a transverse direction as the loom is rocked (see FIG. 4). The shuttles 45 move through the shed formed by the upper and lower warp threads 15 as will be later described. The reeds 22, of course, serve to keep the warp threads 15 aligned, the threads 15 being tensioned between the warp beam 12 and cloth beam 28 by the frame edge 26, the heddles 18, and the edge 27 of the frame adjacent the warp beam 12.

Figure 3:
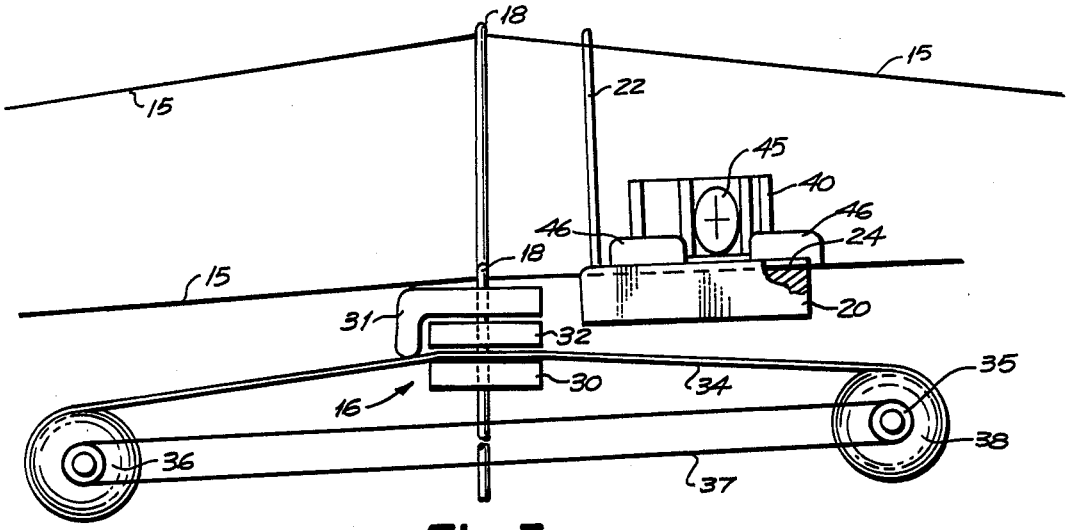
FIG. 3 is a schematic plan view illustrating the relationship between the warp bar assembly, the actuated warp-holding members arranged therein, the program member, and the upright reeds in the shuttle board along which the shuttle slides.

As further discussed at pages b 380 et seq of "The Way Things Work," Volume 1, (Simon and Shuster), Copyright 1967, and the publication "Weaving" by Shirley Held, (Holt, Rinehart & Winston), 1973, the pattern and weave of a cloth is determined by the arrangement and colors of the warp and weft threads. In the present loom assembly 5, the pattern and weave of the cloth is determined by a preprogrammed member 34 (see FIG. 3A) which could comprise a plastic perforated pattern member, or the like. As shown in FIG. 3, the preprogrammed member 34 is adapted to move between a feed roller 36 and a take-up roller 38 through the warp bar assembly 16 which comprises an upper guide 31 and an upper associated perforated member 32 and a lower associated perforated member 30, which are adapted to receive the lower portion of corresponding heddle 18. As the perforated pattern 34 moves through the warp bar assembly 16, the presence or absence of perforations in the programmed member 34 determines whether the respective heddle 18 will be in its upper or lower position, that is, the presence of a perforation determines the lower position of a corresponding heddle and the absence of a perforation determines the upper position thereof, thus establishing the shed through which the shuttle 45 may travel in a manner to be described. It is noted that in this loom assembly 5, the shuttles 45 travel along a smooth shuttle board 20 by the force of gravity as the loom is rocked to and fro upon the rocker members 11, the lower warp threads 15 forming the shed being recessed in the shuttle grooves 24. In many conventional looms, the shuttle must travel across the warps with attendant friction and less efficient operation, a disadvantage eliminated in the present construction.

Figure 1B:
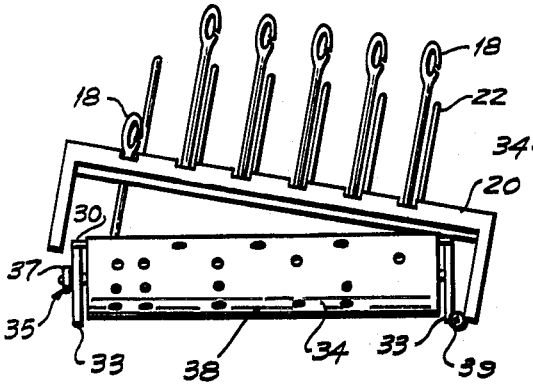
FIG. 1B illustrates the construction of the present loom permitting loading or unloading of the preprogrammed pattern member with comparative ease.
Figure 2:
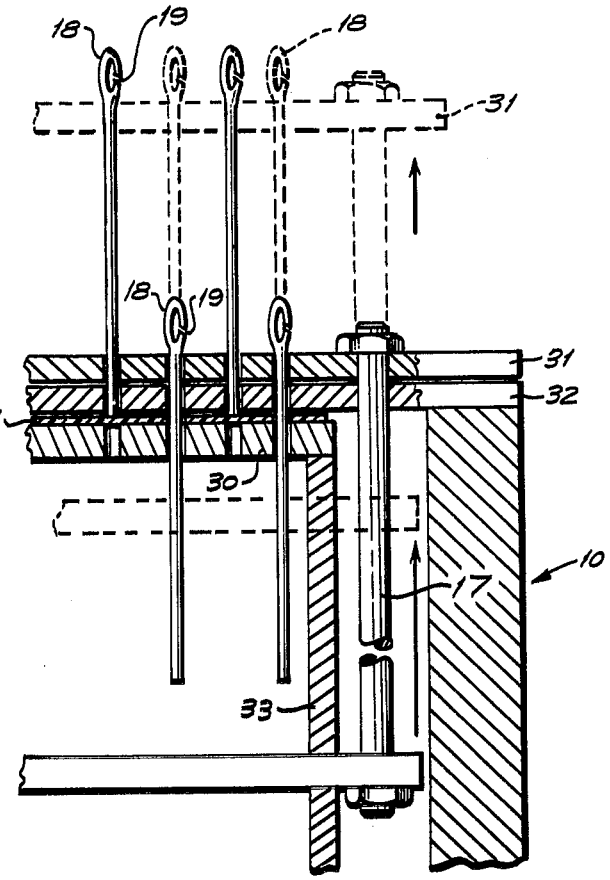
FIG. 2 is a fragmentary sectional view illustrating how insertion of the perforated program member operates to actuate the warp-holding members in a manner whereby the warp threads are adapted to form a shed which receives the shuttle.

To permit patterns to be quickly and easily loaded or removed, the feed roll 36, lower associated perforated member 30 of the warp bar assembly 16, and take-up roll 38 form a unitary sub-assembly which nests within the remainder of the loom assembly 5, being shown in FIGS. 1A and 1B as being held together by a feed pattern sub-assembly frame 33. One side of the sub-assembly frame 33 is attached to one of the loom assembly side boards 10 by a hinge member 39, as shown in FIG. 1B. The loom assembly 5, including the upper guide 31 and the upper perforated member 32 can thus lift upwardly about the hinge 39 to expose (a) the feed roll 36, (b) lower perforated member 30, and (c) the take-up roll 38, which stands ready to accept or yield up the programmed pattern member 34. Such construction permits changing of the pattern member irrespective of whether the loom is dressed, and permits consecutive utilization of a plurality of different patterns in the weaving of a single fabric.

Figure 4:
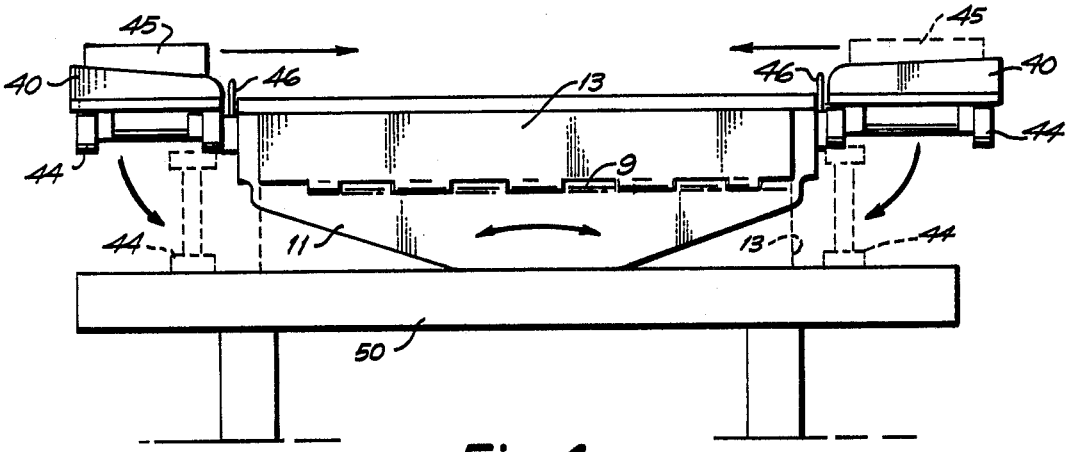
FIG. 4 is an end view of the loom assembly showing the arrangement of the shuttle boxes and the mechanism whereby the shuttles may be actuated by a rocking motion.
Figure 5:
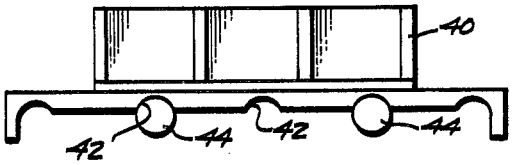
FIG. 5 illustrates the details of the shuttle boxes.

FIGS. 4 and 5 illustrate in more detail the means for handling shuttles 45 with various colors or textures of yarn or weft. In the drawings, the shuttle holder 40 is a three compartment shelf for the shuttles 45, open above and at the side nearest the loom assembly 5. The shuttle holder 40 is supported on two grooved members 42 adapted to receive support dowels 44 which are hinged in a manner whereby they can be lowered, forming added support to the loom assembly 5 when not in use to support the shuttle holders 40. When in operation the support dowels 44 are moved to bring each of the shuttle spaces in the shuttle holder 40 directly in line with the shuttle board 20. Two such shuttle holders 40, one on each side of the loom 5, adjacent the side boards 10, enable the weaver to employ five shuttles, each with a different color or texture of yarn. The shuttles 45, temporarily inactivated, are kept in their separate compartments by a restraining unit 46, as shown in FIGS. 3 and 4. The restraining unit 46 may be a small raised member or tiny wall extending laterally on each side of the loom assembly 5, but which leaves a clear space for the shuttle to leave the shuttle holder 40 and slide on to or off the shuttle board 20 of the loom assembly 5 as it is rocked from side to side.

OPERATION OF THE LOOM

As is herein described, principal advantages to be achieved from my hand loom are: ease and speed in dressing; availability of an infinite variety of patterns on quickly installed, quickly changed pattern rolls; ease and convenience in handling a plurality of shuttles.

Figure 3A:
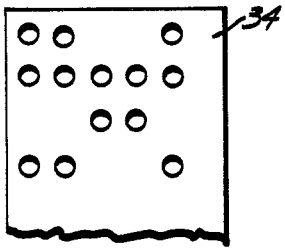
FIG. 3A is an enlarged illustration of the perforated program member.

The preprogrammed member 34, shown in FIG. 3A, consists of a thin, tough material in a sheet wound to travel between a pattern feed roller 36 and pattern take-up roller 38. A roller control mechanism 35 permits the pattern sheet 34 to remain static, to move forward or backward as required, or to move forward or backward in continued, automatic sequence of pattern-row after pattern-row. As illustrated in FIGS. 1B and 3, the roller control mechanism 35 may be a knob arranged on a pulley mounted on the shaft of the take-up roller 38, coupled by a belt 37 to the shaft of the feed roller 36, thereby permitting manual manipulation of the pattern sheet 34. Alternatively, the roller control mechanism could comprise a knob on the shaft of each roller 36, 38 or any other means of moving the rollers known to those skilled in the art. The pattern-rows of perforations in programmed sheet 34 are in parallel alignment with the vertical rows of warp holding heddles 18.

For each shed, a hand lever or foot pedal (not shown) raises the control frame 17 (shown in FIG. 2) of warp-holding heddles 18, so their flat lower ends are all well above the level of the pattern sheet 34 below. The roll of perforations for the next shed is brought into place below the heddles and centered. When the control frame is lowered by reverse pedal or lever action, those heddles 18, coinciding with perforation holes below them, slide through to form a bottom row of warps in the shed. Those heddles with unperforated sheeting below them stand erect, thus supplying the upper warps of the shed.

The shuttle 45 can be sent across the shuttle board 20 both ways by tilting the loom 5 on the rocker members 11. Thus the rocker members 11 may rest in three different positions: horizontal; tilted to the right; or tilted to the left. The shuttle board 20 is made to slope slightly upward in the direction of the cloth beam 28, thereby causing the shuttles 45 to move securely within the slight depression formed between the upward-sloping shuttle board 20 and the reed units 22 at right angles to the plane of the shuttle board 20.

The warp threads 15 slope upward toward the heddles 18 in lowered position. This upward slope is slightly greater than that of the shuttle board 20. From the heddles in lowered position, the warp threads 15 slope parallel with the slope of the shuttle board 20 toward the cloth beam 28. The heddles in lowered position hold the warp threads slightly below the level of the surface of the shuttle board 20. The warps 15 therefore occupy the slots or grooves 24 in the shuttle board 20. These slots 24 are cut at right angles to the length of the shuttle board 20, and between the metal units of the reeds 22. Since the warp threads 15 are below the level of the surface of the shuttle board 20, the shuttle 45 can slide above them without friction against the warps.

The present loom assembly 5 could be constructed without conventional reed members 22, the packing of the weft being done by a "dolphin" topless reed attached to a beater frame (not shown). Vertical upright metal units would rise from below the level of the warps 15, push their very smoothly rounded tops through the warps 15, advance and pack the weft and retrace their way back out of sight.

Two shuttle holders 40, as previously described, are hinged at opposite ends of the shuttle board 20 at the loom assembly sideboards 10. The shuttle holders 40 hang downwardly when out of use to save space. Such holders 40 may hold three, five, or even seven shuttles 45 with yarns of varying textures and colors. Each shuttle holder 40 is arranged to slide forward or backward along the side boards 10 to bring the desired shuttle 45 in line with entrance onto the shuttle board 20 for any given shed.

I claim:

1. In a hand loom, the combination comprising:

means for uniformly advancing a plurality of warp threads in a first direction;

shuttle means including a shuttle board for free movement of at least one weft thread in reciprocal motion solely by gravitational forces across the path of said warp threads in a transverse direction to the direction of said warp threads advance; and means for selectively arranging each of said warp threads in an upper or lower position to form a shed through which said shuttle means passes, said means for selectively arranging each of said warp threads comprising movable warp thread holding means cooperating with means for transporting a pattern member adapted to determine the upper or lower position of each warp thread in conformance with preselected instructions contained upon said pattern member;

said pattern member transport means being adapted to selectively advance in synchronism with said warp threads, move in a direction opposite to the direction of the warp thread advancement, or remain static as said warp threads advance;

said warp thread advancement means and said shuttle means being movable in a vertical plane in a direction away from said pattern transport means to permit ready access thereto.

2. In a hand loom, the combination comprising:

means for uniformly advancing a plurality of warp threads in a first direction;

shuttle means for free movement of at least one weft thread in reciprocal motion across the path of said warp threads solely by gravitational forces, said shuttle means including roller means transporting said shuttle means transversely to the direction of warp thread advance;

means for selectively arranging each of said warp threads in an upper or lower position to form a shed through which said shuttle means passes;

said means for selectively arranging each of said warp threads comprising a warp bar assembly having a plurality of perforations therein, a plurality of heddles slidably mounted to reciprocate within the perforations in said assembly, said heddles being adapted to carry warp thread at the upper end thereof, and means for transporting a pattern member adapted to determine the relative position of each warp thread in conformance with preselected instructions contained in said pattern member;

said pattern member transport means being adapted to selectively advance in synchronism with said warp threads, move in a direction opposite to the direction of the warp thread advancement, or remain static as said warp threads advance;

whereby a woven fabric of a varied weave and pattern may be obtained as said warp threads advance.

3. A loom assembly comprising:

a base member including at least two essentially parallel longitudinal side members;

a warp roller rotatably secured at one end of said base between said side members;

a take-up roller being rotatable only in the same direction, thereby being adapted to carry warp thread from the first roller to the second;

a warp bar assembly arranged intermediate said rollers and between said side members, said warp bar assembly comprising an upper guide member, an upper associated member and a lower associated member, said upper associated member being arranged between said guide member and said lower member, each said member having a plurality of perforations therein in alignment with the perforations of each of the other members;

said warp bar assembly having a plurality of heddles slidably mounted in the perforations therein for vertical, alternate reciprocation and when having warp thread therein, the rising of one heddle and the falling of an adjacent heddle provide alternate warp threads in spaced relation tof form a shed;

a shuttle board arranged transverse to said side members adjacent said warp bar in the direction of the take-up roller, said shuttle board having a plurality of upright metallic reeds thereon to align the warp threads as they travel from the warp roller through the heddles to the take-up roller;

shuttle means for moving at least one weft thread solely by gravitational forces in reciprocal motion on the surface of said shuttle board across the path of said warp threads in a transverse direction as said warp threads advance;

said shuttle means including a shuttle holder adapted to hold at least one shuttle, each such shuttle having a weft thread holding member;

means for arranging a preprogrammed pattern member in cooperative relationship with said heddle members to determine the relative position of each warp thread in said heddle member in conformance with preselected instructions contained upon said pattern member;

said arrangement means being adapted to selectively advance, immobilize, or reverse the direction of movement of said pattern member as said warp threads advance from the first roller to the second;

whereby a woven fabric of a varied weaved and pattern may be obtained as said warp threads advance.

4. A loom assembly as claimed in claim 3 wherein said base member, take-up and warp rollers, upper guide member upper associated member, shuttle board and shuttle means together being movable in a vertical plane away from said pattern arrangement means which nests among them to permit ready insertion or removal of preprogrammed pattern members in said pattern arrangement means.

5. In a hand loom, the combination comprising:

means for uniformly advancing a plurality of warp threads in a first direction;

shuttle means including a shuttle board for free movement of at least one weft thread in reciprocal motion solely by gravitational forces across the path of said warp threads in a transverse direction to the direction of said warp threads advance; and means for selectively arranging each of said warp threads in an upper or lower position to form a shed through which said shuttle means passes, said means being hingedly connected to said warp thread advancement means and said shuttle means;

said means for selectively arranging each of said warp threads comprising:

a warp bar assembly including an upper guide member, an upper associated member, and a lower associated member, said upper associated member being arranged between said guide member and said lower member, each said member having a plurality of perforations therein in alignment with the perforations of each of the other members, a plurality of heddles, adapted to receive warp threads, slidably mounted in said perforations for vertical alternate reciprocation therein, means for transporting a pattern member adapted to determine the relative upper or lower position of each warp thread in conformance with preselected instructions contained upon said pattern member;

said pattern member transport means being adapted to selectively advance in synchronism with said warp threads, move in a direction opposite to the direction of the warp thread advancement, or remain static as said warp threads advance; and a pattern member containing preselected instructions thereon, said pattern member being arranged to move between said upper associated member and said lower associated member; whereby each of said heddles is arranged in an upper or lower position in conformance with the preselected instructions contained upon said pattern member.

6. A loom assembly as claimed in claim 5 wherein said pattern transport means and said lower associated member are connected to form a sub-assembly nesting within the remainder of the loom.

7. A loom assembly as claimed in claim 6 wherein said sub-assembly is hingedly connected to the remainder of the loom, whereby the remainder of the loom may be moved in a vertical plane away from said sub-assembly to permit ready access thereto for ready removal and replacement of said pattern member.

* * * * *